United States Patent [19]

Pogonowski

[11] 4,319,393

[45] Mar. 16, 1982

[54] METHODS OF FORMING SWAGES FOR JOINING TWO SMALL TUBES

[75] Inventor: Ivo C. Pogonowski, Blacksburg, Va.

[73] Assignee: Texaco Inc., White Plains, N.Y.

[21] Appl. No.: 128,751

[22] Filed: Mar. 10, 1980

Related U.S. Application Data

[62] Division of Ser. No. 878,625, Feb. 17, 1978, Pat. No. 4,220,034.

[51] Int. Cl.[3] ..... B23P 19/00

[52] U.S. Cl. ..... 29/434; 29/523

[58] Field of Search ..... 29/434, 523, 252, 243.52, 29/235; 72/399; 166/243, 212, 214

[56] References Cited

U.S. PATENT DOCUMENTS

| | | | |
|---|---|---|---|
| 1,787,423 | 12/1930 | Humphrey | 29/235 X |
| 3,118,124 | 1/1964 | Bleckman | 338/317 |
| 3,289,287 | 12/1966 | Guritz | 29/243.52 |
| 3,555,831 | 1/1971 | Pogonowski | 29/523 X |
| 3,657,797 | 4/1972 | Robinson | 29/243.52 X |
| 3,874,181 | 4/1975 | Pogonowski | 29/523 UX |
| 4,063,473 | 12/1977 | Bozzo | 29/434 |
| 4,075,751 | 2/1978 | Tschoop et al. | 29/252 X |

*Primary Examiner*—Charlie T. Moon

*Attorney, Agent, or Firm*—Carl G. Ries; Theron H. Nichols

[57] ABSTRACT

Three methods for forming three different, double acting, self-contained swages for joining two small diameter tubes are disclosed. Likewise three double acting small diameter (3½ inch) combination hydraulic-mechanical swages assembled by the methods are disclosed using hinge arms with indentation tips thereon for deforming and connecting together two small (less than 7 inches or 18 centimeters diameter) telescopic tubes for casing repair or a flow line connection, for example. Two modifications formed by the methods have links connected to the swaging arms so that with increased pivotal movement of the arm and link, a gain results in the mechanical advantage and indentation force.

6 Claims, 10 Drawing Figures

METHODS OF FORMING SWAGES FOR JOINING TWO SMALL TUBES

This is a division of application Ser. No. 878,625, filed Feb. 17, 1978, now U.S. Pat. No. 4,220,034, issued Sept. 2, 1980.

BACKGROUND OF THE INVENTION

As pipes became more costly and expensive, pipe repair and assembling of pipes becomes a more important job that requires more efficiency.

In gas and oil wells, deteriorating well casings often require repairing and insertion of new pipes to prolong the productive life of the well. Hydraulic swages like those disclosed in U.S. Pat. Nos. 3,540,224 and 3,555,831 have radial acting deforming tips that are used to repair casings or interconnect pipes which are greater than 7 inches (17.78 cm) in diameter. The problem now is that of repairing small pipes, i.e. pipes or tubes of less than 7 inches. The disclosed swages are 3½ inches (8.89 cm) in diameter for repairing and for connecting small pipes. Two typical small coaxial pipes or tubes to be connected have their abutting ends positioned internally of a third short tube therearound, FIG. 1. The invention is used here for connecting one of the abutting tube ends to an end of the third short tube telescoping positioned therearound. Then the invention is used again in connecting the other abutting tube end to the other end of the short tube telescopically positioned therearound.

OBJECTS OF THE INVENTION

Accordingly, a primary object of the invention is to provide a few methods for forming or assembling a few swages for the repair of, or connecting of, two small pipes, pipes or tubes, for example which are less than 7 inches in diameter.

A further object of this invention is to provide a method for forming and assembling a swage for forming contiguous indentations in the wall of two small telescopic tubes that is easy to operate, consists of simple method steps, is economical to operate and is of greater efficiency for the forming and assembling of swages for interconnecting two tubes.

Other objects and various advantages of the disclosed methods for forming three swages will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagrammatically illustrate by way of example, not by way of limitation, three forms of the invention wherein like reference numerals designate corresponding parts in the several views in which.

Figure 1:
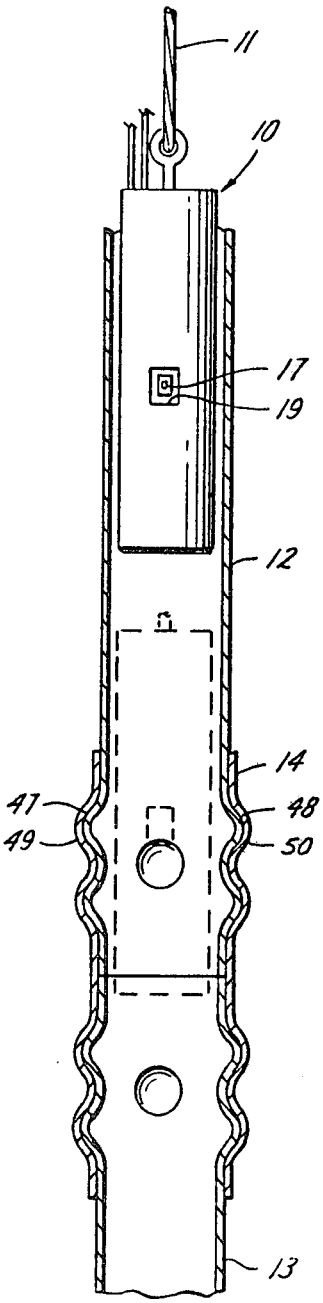
FIG. 1 is a schematic diagrammatic front view of a swage internally of a tube that has been connected to another abutting tube with a short tube around both.

The invention disclosed herein, the scope of which being defined in the appended claims is not limited in its application to the details of construction and arrangement of parts shown and described, since the invention is capable of other embodiments and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitation should be imposed as are indicated in the appended claims.

DESCRIPTION OF THE INVENTION

This invention comprises three methods for assembling of forming a swage for joining together two small telescopic pipes, despite the fact that these three different swages formed may be assembled by other methods, as by hand.

While the two pipes to be repaired or connected together may be any suitable pipes desired, this invention is particularly useful in an oil or gas well for connecting together, in an emergency for example, two small joints of casing in a string of casing or two small joints of production tubing in a string of tubing. Thus the term "tube" or "tubing" recited hereinafter may pertain to any desired pipe.

BASIC METHOD FOR ASSEMBLING OR FORMING A SWAGE

A method for forming a swage (10 of FIG. 1, 10*a* of FIG. 3, or 10*b* of FIG. 7, for examples) for joining the ends of two small (less than 7 inches or 18 cm) telescopic pipes or tubes (12 and 14 or 13 and 14 of FIG. 1) of about a diameter of 3½ inches (9 cm), comprises basically the following steps:

(1) mounting a piston (16, 16*a*, and 63 of FIGS. 1, 3, and 7) in one end of a cylinder (15, 15*a*, and 64 of FIGS. 1, 3, and 7) and placing an end element at the other end of the cylinder (21, 53, and 60 of FIGS. 1, 3, and 7), (2) pivotally connecting one end of an arm (22, 22*a*, and 74 of FIGS. 1, 3, and 7) to the piston, (3) fixing indentation tip means (18, 18*a*, and 76 of FIGS. 1, 3, and 7) to the other end of the arm, and (4) forming biasing means (31, 54, and 30 of FIGS. 1, 3, and 7) for pivoting the arm outwardly transversely of the cylinder responsive to the piston for deforming two contiguous depressions or dimples (48–50 and 48*a*–50*a* of FIGS. 1 and 5) in the two small telescopic tubes for forming a swage for efficiency joining together two small tubes.

METHOD FOR FORMING THE SWAGE OF FIG. 1

The above basic method may be modified to assemble or form a swage as disclosed in FIG. 1 by adding the following steps, (5) pivotally connecting one end (25, FIG. 2) of a second arm (23 of FIG. 2) to the piston (16), (6) crossing the first and second arms (22 and 23), and (7) pivotally connecting an end (29, 28) of each of two biasing means (22, 23) to the respective other ends (33 and 34) of the two crossed arms for forming an efficient swage having increasing mechanical advantage and indentation force with increased indentation movement for deforming two contiguous dimples (48, 50 of FIG. 1) in the ends of both small telescopic tubes (12, 14) for efficiently joining two small tubes (12 and 13) together.

Figure 2:
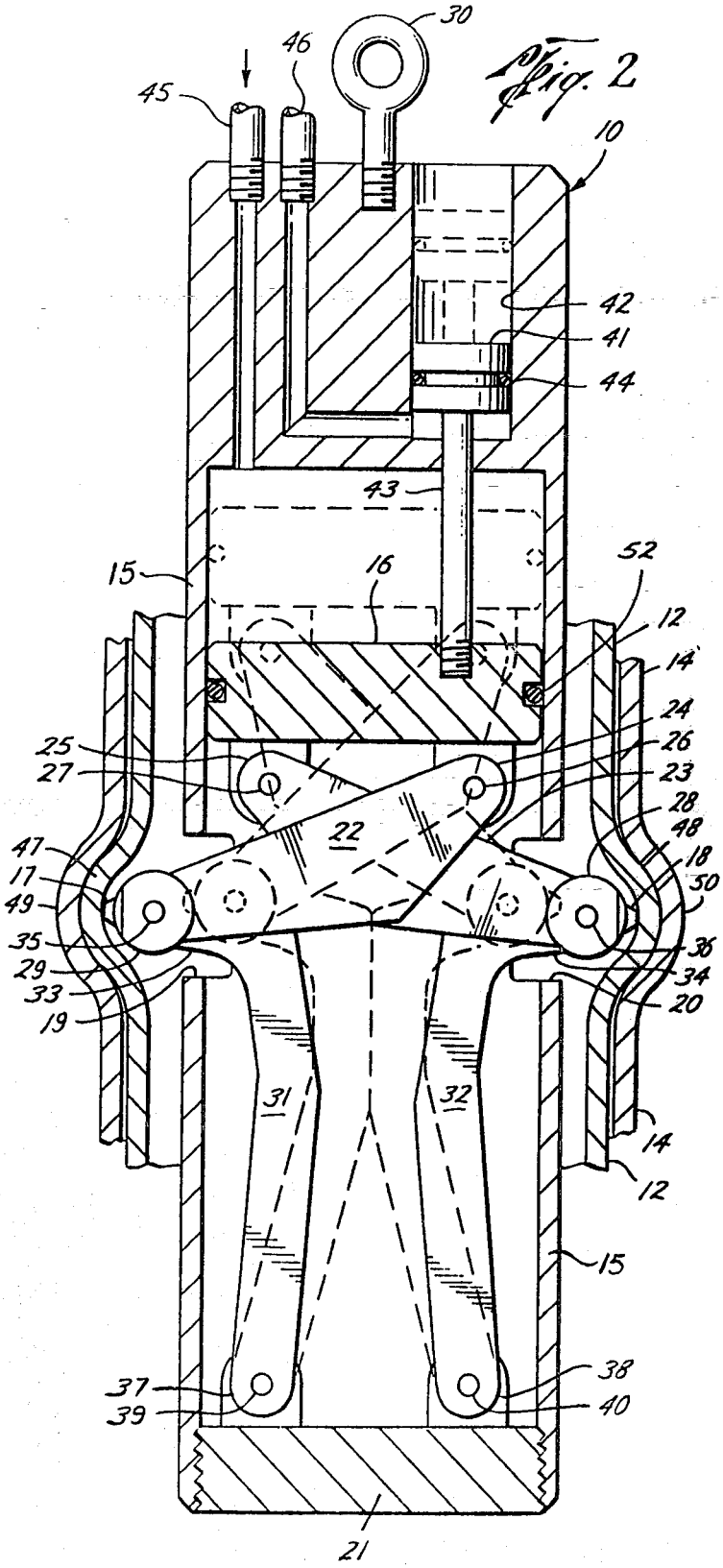
FIG. 2 is a schematic sectional view of an elevation of one modification of the swage illustrated in dimpling position in solid lines and in retracted position in broken lines with parts cut away for clarity of disclosure.

More detailed method steps for forming the swage of FIG. 1 comprise, (1) mounting a piston 16 of FIG. 2) in one end of a cylinder (15) and closing the other end of the cylinder with a cradle (21), (2) pivotally connecting one of the ends of each of first and second arms (22, 23) to the piston, (3) crossing the free ends (29, 28) of the first and second arms with each other, (4) pivotally connecting one of the ends of first and second links (31, 32) to the cradle in the other end of the cylinder, (5) pivotally connecting the free ends (29, 28) of the first and second arms to the respective free ends (33, 34) of the first and second links forming two pairs of free end connections intermediate the piston and cradle, and (6) fixing indentation tips (17, 18) to one of the free ends of each pair forming each connection for forming an efficient swage having increased mechanical advantage and indentation force with increased pivotal movement of the arms so that movement of the piston towards the cradle actuates the two indentation tips outwardly for forming two contiguous dimples in two small telescopic tubes (less than 7 inches in diameter) for efficiently and effectively joining together the two small telescopic tubes.

METHOD FOR FORMING THE SWAGE OF FIG. 3

The above basic method may be modified further to assemble or form a swage as disclosed in FIGS. 3–6 by adding the following steps, (5) forming a guide means (51 of FIG. 3) fixed to the cylinder (15*a*), and (6) shaping the guide means into an arcuate form (54) for causing the indentation tip means to engage and deform the two contiguous dimples (48*a*, 50*a*) in both small telescopic tubes for forming a swage for efficiently and effectively joining together two small telescopic tubes.

METHOD FOR FORMING THE SWAGE OF FIG. 7

Figure 7:
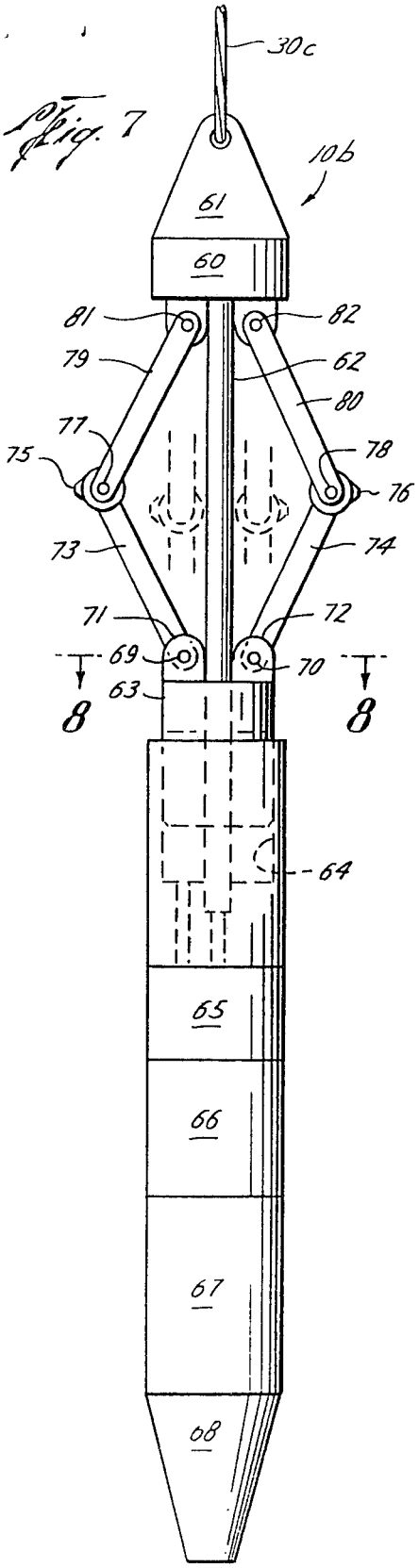
FIG. 7 is a schematic elevation of a third modification of the swage.
Figure 8:
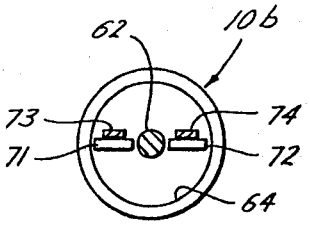
FIG. 8 is a sectional view taken at 8—8 on FIG. 7.
Figure 8A:
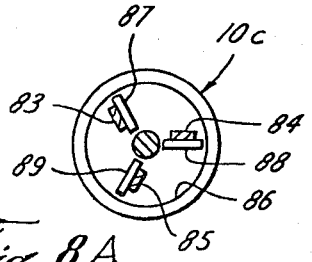
FIG. 8A is a modification of FIG. 8.
Figure 8B:
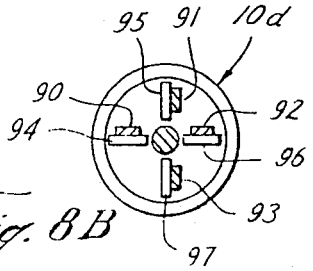
FIG. 8B is another modification of FIG. 8.

The above basic method may be modified and enlarged further to assemble or form a swage as disclosed in FIGS. 7–8B by adding the following steps, (a) forming the piston (63 of FIG. 7) slideable around a guide arm (62), and (b) connecting biasing means (74) to the piston being actuated outwardly for forming a swage having increasing mechanical advantage and indentation force with increasing longitudinal movement of the piston outwardly of the cylinder for efficiently and effectively joining the two small telescopic tubes together.

Besides the above methods for assembling or forming a swage, this invention comprises a mechanism assembled by the above methods and for being assembled by other methods.

SWAGE OF FIGS. 1 AND 2

While various double acting swages may be made or assembled by the above methods, FIG. 1 illustrates one embodiment formed by one of the inventive methods.

FIG. 1 is an elevational view illustrating a swage 10 in a well being raised by support cable 11 to the surface after connecting two elongated, small diameter, less than 7 inches (18 cm) tubes 12 and 13 with a shorter circumscribing telescopic tube 14.

FIG. 2 illustrates in section the double acting swage 10 comprising basically a cylinder 15 with a piston 16 operable therein, the piston being connected through arms and links to the lower end of the cylinder for extending and retracting depression or dimple forming indentation tips 17 and 18 for interconnecting the two small coaxial tubes 12 and 13, FIG. 1, with telescopic tube 14.

In greater detail, cylinder 15, FIG. 2, has slots 19 and 20 on each side thereof and a cradle 21 closing the lower end of the cylinder. Two crossed arms 22 and 23 have their upper ends 24 and 25, respectively, pivotally connected to piston 16 with the respective pins 26 and 27. Depression or dimple forming indentation tips 17 and 18 are fixedly attached to the lower ends 28 and 29 of the respective arms 23 and 22. Cable 11 is attached to a conventional eye 30 in the top of the swage 10 for support thereof. Links 31 and 32 have outwardly curved upper ends 33 and 34, respectively, pivotally connected to the respective arm lower ends 29 and 28 with pivot pins 35 and 36 for biasing the indentation tips 17 and 18 outwardly for deforming the telescopic tubes.

While the indentation tips 17 and 18 are shown mounted on the lower ends 29 and 28, respectively, of the upper arms 22 and 23, they could be mounted on the upper ends 33 and 34 of the lower links 31 and 32 if so required for intrinsically economical engineering design. Lower ends 37 and 38 of links 31 and 32, respectively, are pivotally connected to the cradle 21 with respective pivot pins 39 and 40.

While the solid line position of the internal parts of the swage 10 illustrated in FIG. 2 is the tube deforming or dimpling position, the broken line position illustrated is the indentation tip retracted position. While various power means may be used to make the swage 10 double acting as DC motors, or the like, the preferred power means is a hydraulic system comprising a smaller piston 41 operable in a smaller cylinder 42 in the upper portion of the swage housing above the swage cylinder 15.

Figure 5:
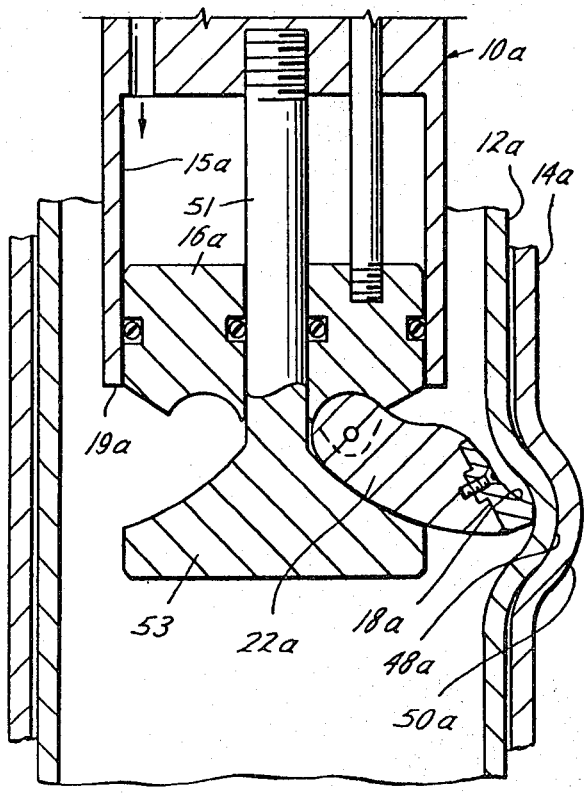
FIG. 5 is an enlarged portion of the sectional view of the swage of FIG. 3 shown in deforming position internally of two tubes to be interconnected.
Figure 6:
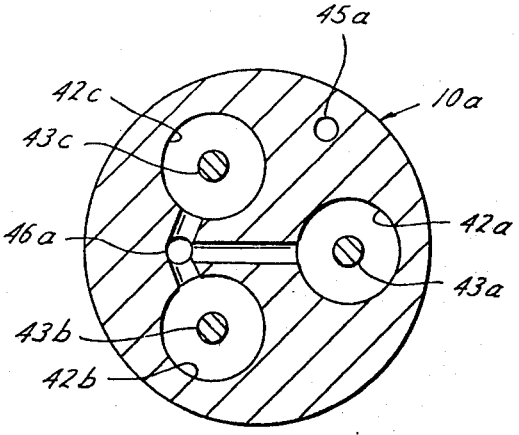
FIG. 6 is a sectional view taken at 6—6 on FIG. 3.

While only one retracting piston and cylinder are shown, and any number may be utilized, the preferred number is three as illustrated in FIG. 6 of the modification of FIGS. 3–6. A piston rod 43 is fixedly connected at its free end to the swage piston 16, as by being screwed into a threaded hole in the piston. Conventional O-rings 44 and 52 are mounted around the pistons 41 and 16, respectively, to insure a fluid tight fit. Line 45 supplies high pressure hydraulic fluid to cylinder 15 when called for, for actuating swage piston 16 and the connected linkage to the deforming solid line position.

Line 46 supplies high pressure hydraulic fluid to the underside of small piston 41 in small cylinder 42 for raising the piston for raising the swage internal parts to the broken line, retracted position illustrated in FIG. 2.

An important feature of this linkage is that the outwardly curved links or biasing means 31 and 32 position their interconnecting intermediate pivot pins 35 and 36 outboard of their line of centers or line of their respective pairs of pivot pin centers 27-39 and 26-40. Accordingly, with increased outward or deforming movement of the arms and indentation tips, increased mechanical advantage and increased indentation force results, particularly after the line connecting the pivot pins 35-26 and 27-36 of arms 22 and 23 have passed the 45° position to the cylinder longitudinal axis. Attaching and supporting eye 30*a*, FIG. 2, permits lowering of the swage 10*a* to the desired level in the small tubes.

Briefly in operation hydraulic fluid under high pressure is supplied by a suitable controlled source (not shown) through line 45 illustrated in FIG. 2 to cylinder 15 for actuating swage piston 16 from the broken line position to the solid line position. As depression forming indentation tips 17 and 18 are actuated radially outwardly of the cylinder 15 through slots 19 and 20, respectively, they contact the two small telescoped sleeves or tubes 12 and 13 at a particular predetermined location. Upon the indentation tips reaching the solid line position, a pair of opposite dimples 47, 48, in tube 12, FIGS. 1 and 2, are formed contiguous with dimples 49 and 50 in tube 14, FIGS. 1 and 2, for example. Finally, the fluid in line 45 is vented to a return sump (not shown) and high pressure hydraulic fluid is supplied through line 46 to cylinder 42 for raising piston 41 for retracting the indentation tips.

Then the swage 10, FIG. 1, may be rotated 90°, lowered one dimple diameter and two more oppositely positioned contiguous dimples formed in the two telescopic tubes. Any desired pattern of contiguous dimples may be formed as illustrated in FIG. 1 for securely and efficiently interconnecting the two small coaxial tubes 12 and 13 together with the third and telescopic tube 14.

SWAGE OF FIGS. 3-6

FIGS. 3-6 are sectional views illustrating a modified swage 10*a* likewise made by one of the above inventive methods for lowering into a well internally of the casing, and particularly inside small casing, as a casing having a diameter of less than 7 inches (17.78 cm) for interconnecting two tubes 12 and 13, FIG. 1, with a short circumscribing telescopic tube 14, FIGS. 1, 2, and 5, therearound and contiguous therewith.

Figure 3:
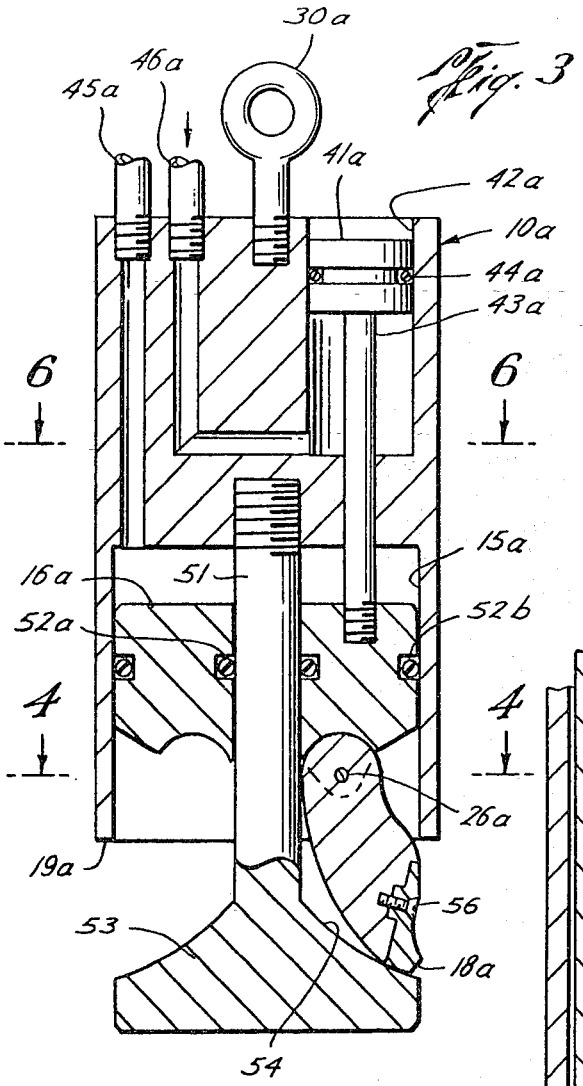
FIG. 3 is a schematic section view taken at 3—3 on FIG. 4 of a second modification of the swage illustrated in retracted position.
Figure 4:
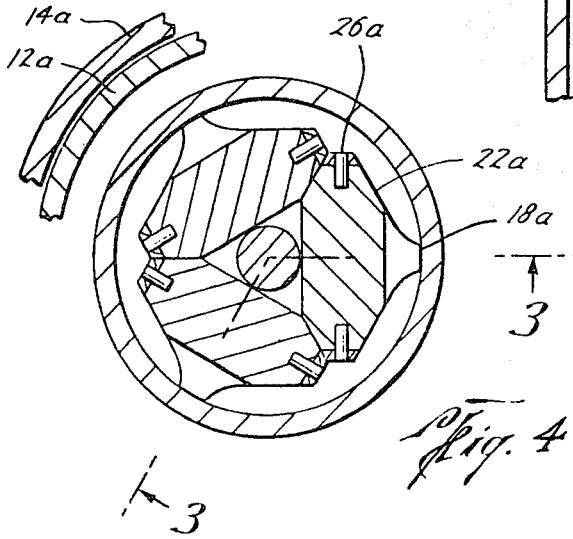
FIG. 4 is a sectional view taken at 4—4 on FIG. 3.

FIG. 3 illustrates a sectional view of an elevation of the modified swage 10*a* comprising basically a cylinder 15*a* having a piston 16*a* operable therein, the piston surrounding and being slideable on a shaft 51 for extending and retracting an arm 22*a* carrying a dimple forming indentation tip 18*a* for interconnecting the two small coaxial tubes 12, FIGS. 4, 5, and 13, FIG. 1, with circumscribing telescopic tube 14, FIGS. 1, 4, 5.

In more detail, the shaft 51, FIG. 3, protrudes up through the middle of cylinder 15*a* and piston 16*a* for being fixedly secured in the top of the cylinder with screw threads. A lower end 53 of shaft 51 radiates out to a diameter substantially equal to that of the cylinder and has a plurality of arcuate surfaces thereon, one surface for each indentation tip carrying arm, as arcuate surface 54 for biasing or forcing outwardly arm 22*a* carrying dimple forming indentation tip 18*a* secured with screw 56, for example. The upper end of arm 22*a* is pivotally connected to the lower portion of piston 16*a* with pivot pin 26*a*.

The deforming piston actuation system of FIG. 3 is similar to that of FIG. 2, wherein smaller piston 41*a*, operable in cylinder 42*a*, has piston rod 43*a* fixedly connected to large deforming piston 16*a* by screw threads, for example. O-rings 44*a* and 52*a*-52*b* seal pistons 41*a* and 16*a*, respectively, in their respective cylinders 42*a* and 15*a*. High pressure hydraulic line 45*a* supplies high pressure fluid to the cylinder 15*a* and line 46*a* supplies high pressure fluid to cylinder 42*a* as required and controlled with suitable valves (not shown).

Outwardly biasing movement of deforming indentation tip 18*a*, FIG. 5, forms contiguous dimples 48*a* and 50*a* in the telescopic tubes 12*a* and 14*a*, respectively. As many additional contiguous dimples are formed around the two tubes and spaced at various distances from the peripheral edges of both tubes as deemed required before the swage is lowered to secure the second coaxial tube 13 to the overlying telescopic third tube 14 with a similar pattern of dimples made by the new method and apparatus of FIGS. 3-6.

While any number of pivotal arms may be used, FIG. 4, a sectional view at 4—4 on FIG. 3, illustrates the preferred number of arms to be three, all equally spaced radially about shaft 51 and similar to pivotal arm 22*a*.

FIG. 5, an enlarged view of a portion of FIG. 3, illustrates the swage 10*a* after having formed the two contiguous dimples 48*a* and 50*a* in the telescopic tubes 12*a* and 14*a*.

FIG. 6, a section at 6—6 on FIG. 3, shows a top view of the hydraulic system for extending and retracting the deforming indentation tip 18*a*. High pressure hydraulic fluid is supplied from line 46*a*, FIG. 6, to the three similar retracting cylinders 42*a*, 42*b*, and 42*c* for actuating their respective piston rods 43*a*, 43*b*, and 43*c*.

Briefly, in operation of the modification of FIGS. 3-6, high pressure fluid is supplied by a suitable controlled source (not shown) through line 45*a*, FIG. 3, to cylinder 15*a* for actuating swage piston 16*a* from its retracted position of FIG. 3 to its extended position of FIG. 5. Thus as dimple forming indentation tips 18*a*, 18*b*, and 18*c*, FIG. 4, are actuated radially outwardly of the cylinder 15*a*, FIG. 5, through a slot 19*a*, they contact the two small telescoped tubes 12*a*, 14*a* at a particular predetermined location. As the indentation tips on arm 22*a* reach the extended position illustrated in FIG. 5, a pair of contiguous dimples 48*a* and 50*a* is formed by each indentation tip. Then the high pressure fluid is valved over from line 45*a* to line 46*a* for actuating retracting piston 41*a* up to retracted position illustrated in FIG. 3 to retract the arm 22*a*, FIG. 5, with its indentation tip 18*a* to the retracted position of FIG. 3. Then the swage may be raised or lowered and rotated for forming any desired pattern of contiguous dimples for securing the ends of telescopic tube 14*a* around and to the juxtapositioned ends of tubes 12 and 13, as illustrated in FIG. 1.

SWAGES OF FIGS. 7-8B

FIG. 7 is an elevation of another basic modification of a small diameter (less than 7 inches or 18 cm) swage 10*b* formed and assembled by one of the above inventive methods comprising basically a motor for extending depression forming indentation tips mounted on pairs of interconnected links.

More specifically, the swage 10*b*, FIG. 7, comprises a head 60 having a support eye 61 and being fixedly connected to rigid conduit 62 of the main body, which in turn includes a piston and cylinder 63, 64, respectively, driven by a hydraulic gear pump 65 connected to a hydraulic fluid reservoir 66 with a bank of conventional reversible DC motors 67 connected to a common drive shaft for driving the gear pump, and a stabbing guide 68 for including ballast, if so desired. Support and wire line and electrical cable 30*c* connected to eye 61 supplies the electrical current for the DC motors 67 for driving the gear pump 65 for actuating piston 63 longitudinally in its cylinder 64.

A linkage system connected to the piston actuates the deforming or dimpling means of swage 10*b*, FIG. 7. Two pins 69 and 70 pivotally connect upper extending projections 71 and 72 on the piston 63 to the lower ends of actuating links 73 and 74. Depression forming indentation tips 75 and 76 are fixedly mounted on the upper ends of the actuating links 73, 74, respectively, and extending radially outwardly. Pivot pins 77 and 78 pivotally connect upper links 79 and 80 to the respective lower actuating links 73 and 74, while pivot pins 81 and 82 pivotally connect the upper ends of the upper links to lower extending projections on the underside of the swage head 60. Compression springs (not shown), or the like, may be positioned between the rigid conduit 62 and links 79 and 80 for biasing the indentation tips 75, 76 outwardly.

FIG. 8, a section at 8—8 on FIG. 7 of swage 10*b* illustrates the two radially oppositely positioned actuating lower links 73 and 74 pivotally connected to piston projections 71 and 72 for being actuated upwardly to extend and retract deforming indentation tips 75 and 76, respectively, as for forming contiguous dimples in the ends of the two telescopic small tubes 12 and 14 or 13 and 14, FIG. 1.

FIG. 8A, a view similar to that of FIG. 8, illustrates a modified swage 10*c* in which three circumferential equally spaced actuating links 83, 84, and 85 are pivotally connected to the piston projections 87, 88, and 89, the piston being operable in cylinder 86 for extending and retracting the deforming indentation tips for forming contiguous dimples in the ends of the two small telescopic tubes 12 and 14 or 13 and 14, FIG. 1.

FIG. 8B, a view similar to FIG. 8, illustrates another modified swage 10*d* wherein four circumferentially equally spaced actuating links 90, 91, 92, and 93 are pivotally connected to the piston projections 94, 95, 96, and 97, respectively for extending and retracting the deforming indentation tips for forming contiguous dimples in the ends of the two small telescopic tubes 12 and 14 or 13 and 14, FIG. 1.

Briefly, in operation of the modification of FIGS. 7 and 8, the swage 10*b* is lowered down internally of the ends of two telescopic tubes to be connected to each other with the forming of contiguous dimples therein. Reversible DC motors 67, FIG. 7, connected to power line 30*c*, drive hydraulic gear pump 65 for raising and lowering the piston 63 for actuating outwardly the dimple forming indentation tips 75 and 76 on the linkage for forming the two opposite pairs of contiguous dimples 48 and 50, FIG. 1, in the ends of the small telescopic tubes 12 and 14 and 13 and 14.

As in the first modification of FIGS. 1–2, with increased outward or deforming movement of the indentation tips of this modification of FIGS. 7–8, increased mechanical advantage and increased indentation force results, particularly after the links forming the pairs 73-79, FIG. 7, and 74-80 pivot to less than 90° to each other.

While the above swages are illustrated and described in vertical position in vertical pipes, obviously they may be positioned at any other angle with the vertical for interconnecting two pipes at any angle with the vertical.

Thus accordingly, it will be seen that the present methods for forming a swage and the various swages operate in a manner which meets each of the objects set forth hereinbefore.

While only three basic methods for forming and assembling a swage of the invention have been disclosed, it will be evident that various other methods are possible for forming various other swages without departing from the scope of the invention, and it is accordingly desired to comprehend within the purview of this invention such modifications as may be considered to fall within the scope of the appended claims.

I claim:

1. (FIGS. 1 and 2) A method for forming a swage for joining together two small telescopic tubes comprising, (a) mounting a piston having an axis in one end of a cylinder for operation therein, (b) pivotally connecting one end of a first arm to the piston on one side of the piston axis, (c) pivotally connecting one end of a second arm to the piston on the other side of the piston axis, (d) fixing first indentation tip means to the other end of the first arm on the other side of the piston axis, (e) fixing second indentation tip means to the other end of the second arm on the one side of the piston axis, and (f) forming biasing means for pivoting said other ends of the respective arms outwardly transversely of the cylinder responsive to movement of the piston toward the arms for deforming two contiguous dimples in the two small telescopic tubes for thus forming a swage for efficiently joining together two small tubes.

2. (FIGS. 1–2) A method for forming a swage for joining together two small telescopic tubes as recited in claim 1 comprising further, (a) crossing the first and second arms.

3. (FIGS. 1–2) A method for forming a swage for joining together two small telescopic tubes comprising, (a) mounting a piston in one end of a cylinder and closing the other end of the cylinder with a cradle (21, FIG. 2), (b) pivotally connecting one of the ends of each of first and second arms to the piston, (c) crossing the free ends of the first and second arms with each other, (d) pivotally connecting one of the ends of first and second links to the cradle in the other end of the cylinder, (e) pivotally connecting the free ends of the first and second arms to the respective free ends of the first and second links forming two pairs of free end connections intermediate the piston and cradle, and (f) fixing indentation tips to one of the free ends of each pair forming each connection for forming an efficient swage having increased mechanical advantage and indentation force with increased pivotal and indentation movement of the arms so that movement of the piston towards the cradle actuates the two indentation tips outwardly for forming two contiguous dimples in the two small telescopic tubes for efficiently and effectively joining together the two small telescopic tubes.

4. (FIGS. 1-2) A method as recited in claim 1 wherein the piston and cylinder each have a coaxial longitudinal axis and wherein the last step comprises further, (a) positioning the other end of the arm on the same side of the piston axis as the biasing means so that the indentation tips are actuated outwardly with increasing indentation force and mechanical advantage with longitudinal movement of the piston for the efficient joining of the two tubes together.

5. (FIGS. 1-2) A method as recited in claim 1 wherein the piston and cylinder each have a coaxial longitudinal axis and wherein the last step comprises further, (a) pivotally connecting the biasing means to the other end of the arm on the side of the piston axis opposite to the side where the arm is connected to the piston whereby the indentation tip is actuated outwardly with increasing force and mechanical advantage with longitudinal movement of the piston for efficient joining of the two tubes together.

6. (FIGS. 1-2) A method as recited in claim 1 wherein the piston and cylinder each have a coaxial longitudinal axis and wherein the last step comprises further, (a) pivotally connecting the biasing means to the other end of the cylinder on the side of the piston axis opposite to the side where the arm is connected to the piston for forming an efficient swage having increasing mechanical advantage and indentation force with increasing longitudinal movement of the piston out of the cylinder for forming a swage for efficiently and effectively joining the two small telescopic tubes together.

* * * * *